US008960807B2

(12) United States Patent
Weigel et al.

(10) Patent No.: US 8,960,807 B2
(45) Date of Patent: Feb. 24, 2015

(54) HYDRAULIC CIRCUIT FOR LONGWALL MINING

(75) Inventors: Wilfried Weigel, Werne (DE); Gerhard Wülfing, Velbert (DE); Peter Rahms, Billerbeck (DE)

(73) Assignee: Tiefenbach Control Systems GmbH, Bochum (DE)

( * ) Notice: Subject to any disclaimer, the term of this patent is extended or adjusted under 35 U.S.C. 154(b) by 189 days.

(21) Appl. No.: 13/382,207

(22) PCT Filed: Jun. 18, 2010

(86) PCT No.: PCT/DE2010/000685
§ 371 (c)(1),
(2), (4) Date: Jan. 4, 2012

(87) PCT Pub. No.: WO2011/006461
PCT Pub. Date: Jan. 20, 2011

(65) Prior Publication Data

US 2012/0104829 A1 May 3, 2012

(30) Foreign Application Priority Data

Jul. 16, 2009 (DE) ..... 10 2009 033 572

(51) Int. Cl.
*E21D 23/26* (2006.01)
*E21D 23/18* (2006.01)
*F15B 19/00* (2006.01)

(52) U.S. Cl.
CPC ..... *E21D 23/26* (2013.01); *E21D 23/18* (2013.01); *F15B 19/005* (2013.01)
USPC ..... 299/1.7

(58) Field of Classification Search
USPC ..... 299/1.3, 1.7; 405/302; 91/170 MP
See application file for complete search history.

(56) References Cited

U.S. PATENT DOCUMENTS 3,672,174 A * 6/1972 Von Hippel ..... 405/295
3,724,329 A 4/1973 Grebe (Continued)

FOREIGN PATENT DOCUMENTS

CN 1916429 A 2/2007
DE 12 55 613 B 12/1967

(Continued)

OTHER PUBLICATIONS

Office Action for Chinese Application No. 201080005407.3 dated Mar. 5, 2014.

(Continued)

*Primary Examiner* — David Bagnell
*Assistant Examiner* — Michael Goodwin
(74) *Attorney, Agent, or Firm* — Alston & Bird LLP

(57) ABSTRACT

A hydraulic circuit for longwall support for use in underground mining for supporting a longwall by means of a plurality of support shields incorporates a pressure monitoring device in the pressure line between the load maintaining valve and the shield control valve. The pressure monitoring device can be a device for monitoring the piston position of the shield control valve which device signals a deviation of the set position predetermined by the shield control device from the measured actual position of the piston of the shield control valve in the form of a deviation signal. It may also be a pressure sensor which signals the deviation of the set pressure predetermined by the shield control device from the measured actual pressure in the form of a deviation signal. Signaling can be acoustic or optical.

11 Claims, 2 Drawing Sheets

(56) References Cited

U.S. PATENT DOCUMENTS

| | | | | |
|---|---|---|---|---|
| 4,109,472 | A | 8/1978 | Harris | |
| 4,146,271 | A * | 3/1979 | Ward et al. | 299/1.7 |
| 4,485,724 | A | 12/1984 | Demircan et al. | |
| 4,904,115 | A * | 2/1990 | Lebreton | 405/143 |
| 5,060,556 | A * | 10/1991 | Weirich et al. | 91/527 |
| 6,957,166 | B1 * | 10/2005 | Howie et al. | 702/173 |
| 7,428,861 | B2 * | 9/2008 | Dettmers et al. | 91/508 |
| 7,478,884 | B2 * | 1/2009 | Kussel | 299/1.7 |
| 7,810,424 | B2 * | 10/2010 | Voss | 91/170 MP |
| 2004/0258487 | A1 * | 12/2004 | Suilmann et al. | 405/294 |
| 2006/0042243 | A1 | 3/2006 | Kussel | |
| 2012/0104829 | A1 | 5/2012 | Weigel et al. | |

FOREIGN PATENT DOCUMENTS

| | | | |
|---|---|---|---|
| DE | 14 58 672 | B1 | 2/1970 |
| DE | 14 83 906 | A1 | 7/1970 |
| DE | 28 38 374 | B1 | 1/1980 |
| DE | 31 28 279 | A1 | 2/1983 |
| DE | 38 04 848 | A1 | 8/1989 |
| DE | 198 42 460 | A1 | 3/1999 |
| DE | 102 07 698 | A1 | 10/2002 |
| DE | 10 2004 017 712 | A1 | 12/2004 |
| DE | 10 2006 055393 | A1 | 11/2007 |
| EP | 1 752 664 | A2 | 2/2007 |
| GB | 2329429 | A * | 3/1999 |
| WO | WO-2005/054629 | A1 | 6/2005 |

OTHER PUBLICATIONS

International Search Reporting and Written Opinion for Application No. PCT/DE2010/000685 dated Feb. 17, 2012.

Office Action for Australian Application No. 2010272979 dated Jun. 23, 2014.

International Search Report and Written Opinion for Application No. PCT/DE2010/000685 dated Feb. 17, 2012.

International Search Report and Written Opinion for Application No. PCT/DE2013/000053 dated Apr. 1, 2014.

International Preliminary Report on Patentability for Application No. PCT/DE2013/000053 dated Aug. 19, 2014.

* cited by examiner

HYDRAULIC CIRCUIT FOR LONGWALL MINING

BACKGROUND OF THE INVENTION

1. Field of the Invention

The invention relates to a hydraulic circuit for longwall mining by means of a support device (support shield) for underground mining according to the various embodiments described herein.

2. Description of Related Art

Such circuits are generally known and in use. They are hydraulic systems controlled by inherent system pressure. The pump pressure in the hydraulic circulating system is also used for the pilot control of the valves. This approach has become dominant in control technology for mining. It enables the use of only two supply lines to the longwall. In contrast to this approach, systems with outside control generate the hydraulic pilot control commands via separate control valves which work independently of the load pressure or pump pressure, wherein the control valves are supplied with pressurizing agent via separate pressure lines. Such a system necessarily involves a separate line for the returning control materials. This also increases the amount and complexity of tubing in the system. When problems arise, it is very difficult to locate the problem, because it cannot be ruled out that both pressure supply lines—meaning the working pressure supply line and the pilot control pressure line—are influencing each other mutually. Also, the valves have a significantly more complex technical construction, particularly with respect to pressure equalizing functions and seals, due to the requirement that the working pressure not be coupled to the pilot control pressure.

On the other hand, the high standards for safety in the mining industry, which also apply to hydraulic systems controlled by inherent system pressure, require significant inputs for safety measures. These inputs are made more complex by the high complexity and the number of control elements and switching elements in a longwall operation, particularly control valves and load holding valves. The primary requirement is that hydraulic systems designed for shielded mining methods must ensure the safety of underground personnel below the supports in the longwall area, despite the large number of possible operating conditions, including unacceptable operating conditions or unplanned disruptions.

WO2005054629 discloses a comparable hydraulic circuit, wherein the pressure sensors monitor the presence of a minimal pressure in the longwall supply line 1, said line connecting the hydraulically operated cylinder/piston units, as well as the hydraulic control valves assigned thereto, to the pump via a pump branch line. Said pressure sensors are connected to the electrical control unit (5) to allow shutting off of the system.

This design ensures that the hydraulic control valves assigned to the cylinder/piston units are only operated once the inherent system pressure has built to a sufficient degree to support the roof of the mine, particularly upon startup of the pumps. However, after normal startup of the pumps, it is not possible to prevent the controllable check valve—which holds the cylinder/piston unit against the roof pressure—from receiving a wrongful control command, particularly not in the case of irregularities within a single support shield.

DE 10 2004 017 712 A1 discloses a comparable hydraulic circuit, wherein the power source in each support shield, along with its associated control valve, is connected to the return line via a shared common return line, and a group blocking valve which is assigned to the support shield is switched closed depending on the hydraulic current in the common return line when the hydraulic current falls below a threshold value. In this case, a volume current is the basis for switching closed the valve at the support shield without pressure. However, as such, it is not possible to prevent irregular pressure states in the supply or return, such that it is possible that undesired and wrongful switching can occur, particularly unblocking of the check valve which holds the roof pressure.

Therefore, despite these safety measures, it has been observed that undesired functions can be triggered or executed, and negatively influence personnel safety.

Relevant causes may include: loose valve seals, which release the pressure applied on the holding cylinders or working cylinders of the support shield(s); open valves or valves that are jammed open; jammed-open pilot valves; blockage in the return line, which can result in the undesired opening of safety valves or load holding valves/releasable check valves (depending on the area ratio of the control piston), and/or which can extend the cylinder/piston units.

The problem addressed by the invention is that of designing the hydraulic systems which are currently in operation and are controlled by their own system pressure in such a manner that the aforementioned life-threatening and costly disruptions cannot occur, and also in such a manner that it is possible to retrofit existing systems without significant conversion inputs.

SUMMARY OF VARIOUS EMBODIMENTS

The solution according to one embodiment of the present invention involves an unexpected realization that the hydraulic situation between the control valves and load holding valves/releasable check valves carries significant and critical importance for the safety of the hydraulic part of the control system. By means of the suggested pressure monitoring for this point, it is possible to prevent unforeseen operating states in which pressure builds up to the point where it is capable of hydraulically piloting—i.e., opening—important valves, even in cases of failure of the pump system or emergency shutoffs of the entire electrical and hydraulic control system, and also in cases of very high roof pressures which exceed the capabilities of the load holding valves.

The suggested pressure monitoring device can have a function in the hydraulic circuit. However, it can also be used only to signal irregular pressure conditions to the operator, i.e., to the relevant longwall control unit or to the central control unit. Also, rather than signaling every small pressure, a threshold pressure is determined and prespecified at which unsafe operating conditions for the hydraulic system in the longwall mine space can be expected. The design of the invention according to another embodiment avoids significant complexity for the construction of the pressure monitoring device, and only relates to monitoring of the position of the piston of the support shield control valve.

The design of the invention according to this embodiment is based on the assumption that conditions where absolutely no pressure is present will not occur, and therefore is only concerned with avoiding situations in which high pressure forms, which can result in undesired valve switching operations.

As suggested in another embodiment, the invention can be limited to producing only acoustic or visual signals in the event that the pressure exceeds a given threshold, thereby leading to action by the operator.

However, the invention also offers the possibility of complying with the highest of safety requirements, in that the exceeding of an impermissible pressure automatically prevents those operating conditions which could lead to dangerous situations, particularly over-pressure operation of the cylinder/piston unit.

A further embodiment provides a cost-effective and robust design for a pressure sensor which meets the demands of the invention.

In another further embodiment, the ring piston line (10) for each cylinder/piston unit ( ) is also monitored by a pressure sensor ( ). By means of this sensor, the entire longwall system can be depressurized if a prespecified pressure threshold is reached, in particular so that it is not possible for the check valve holding the roof pressure to become unblocked.

In the aforementioned WO2005054629, pressure sensors (8, 7) monitor and detect the presence of a prespecified maximum pressure in the collective return line, said sensors being located at a distance from the one or multiple support shields and being connected to the electrical control unit (5) for the purpose of shutting off the system. In contrast, according to the invention, the pressure sensor is provided between the cylinder/piston unit and the connection of each support shield to the collective return line. Only in this way is it possible to monitor and ensure that the releasable check valve is not released by a sudden blockage in the return line and the resulting increase in pressure. The releasable check valve is usually released at a pressure of 80 bar; as such, the permissible maximum pressure must be set lower, at 50 bar for example.

BRIEF DESCRIPTION OF THE SEVERAL VIEWS OF THE DRAWINGS

The invention is explained below using one embodiment thereof. The following figures are referenced.

Figure 1A:
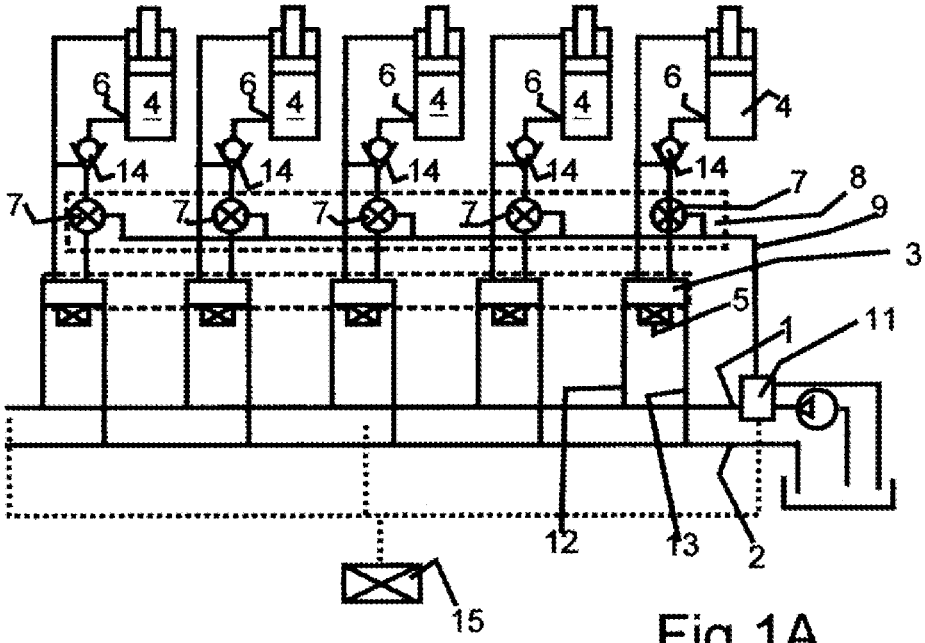
FIG. 1A, 1B: The electrical/hydraulic circuit of a support shield in a longwall mine

The longwall supply line (collective pump line, supply), which extends along a part of the longwall or along the entire length of the panel, and which is connected to the pumping station.

The collective return line (collective return line, return), which extends along a part of the longwall or along the entire length of the panel, and which is connected to the tank at the pumping station.

The hydraulic control unit for the support shield control device for a mining support shield. One of the power sources 4 is shown. The hydraulic control unit is connected to the supply via the branch supply line 12, and to the return via the branch return line 13.

A power source, illustrated here as a cylinder/piston unit.

The electrical control unit of the support shield control unit, for controlling the hydraulic control unit. This receives switching commands from the central longwall control unit 15.

Additional auxiliary valves, particularly check valves, are not illustrated.

Multiple valves are part of the hydraulic control unit. These are indicated in the principle sketch according to FIG. 2.

DETAILED DESCRIPTION

As a primary aspect of the design, the connection (branch pump line) of each power source to the collective pump line of the longwall system is blocked between the power source output, which is subject to the load produced by the roof pressure, and the hydraulic control unit 5 by means of a load holding valve 14 which is designed as a releasable check valve, such that in the event of a disruption or shutoff of the pump pressure, the load pressure from the power source is applied at the tightly closing check valve 14. This check valve 14, however, can by released by system pressure by means of the hydraulic pilot control in cases where the pressure differential between the load pressure and the pilot control pressure falls below a value which is predetermined by the construction of the valve. The check valve 14 is hydraulically switched in such a manner that, in the event that it is hydraulically released, the working space of the power source is connected to the collective return line via the outlet 6 and the branch return line. Such a releasable check valve is known from, for example, DE 38 04 848 A1.

The pressure monitoring device 7 according to the invention prevents the pressure between the releasable check valve and the hydraulic control unit 5 from reaching a pressure that can lead to undesired and, particularly, unsafe functions of the hydraulic devices of the support shield which are controlled by inherent system pressure, especially, for example, wrongful release (switching) of the check valve 14 operating as a load holding valve. The permissible pressure is determined according to the design of the hydraulic system, as well as the safety requirements. Maximum values may be in the range between 0 and 100 bar, for example 50 bar.

The pressure monitoring devices 7 according to this invention can be pressure sensors and pressure switches. Pressure switches are characterized by a simple and robust construction, and only have one ON/OFF signal for events in which a prespecified threshold pressure (maximum pressure) is exceeded.

However, the pressure monitoring device 7 can also be, for example, simply a pressure-activated warning light, which shows a green LED when pressure is below a maximum value, and a red LED when pressure exceeds the maximum value. Alternatively or additionally, an acoustic signal can also be given in the event that the maximum value is exceeded. The signals can be given at every support shield, at the support shield control unit, or at the central control unit 15. However, the system can also be designed such that the pressure monitoring device 7 shuts off the electronics 5 when a maximum pressure of 30 bar is reached, so that it is no longer possible for the valve to be operated.

In this way, it is in fact still possible that the working piston in such a power source, the operation of which has been interrupted in the course of executing a mining function, drops, and a large amount of fluid in the return line results in a corresponding increase in back pressure, as well as a drop in the load holding pressure, such that the pressure ratio required to block the check valve 14 is no longer in place; however, this danger is immediately signaled and/or leads to an appropriate intervention in the function of the mining device.

The design illustrated in FIG. 1A suggests that the pressure monitoring devices of multiple power sources of a support shield are also arranged together into one monitoring unit 8. A preferred prerequisite for this is that the hydraulic control units of the same power source are also collected into one so-called valve block (not shown here). The monitoring device 8 can be integrated into the valve block. The monitoring device 8 is connected to the longwall shutoff valve 11 and the central longwall control unit 15 by means of an electrical monitoring bus line 9. The pressure monitoring devices, which have an electrical output signal, are connected to the monitoring bus line 9 by means of electrical branch lines, such that, in the event of the permitted maximum pressure being exceeded at one of the pressure monitoring devices, necessary measures can be taken to ensure operational safety—from targeted interventions to full shutdown of the entire mining operation.

Figure 1B:
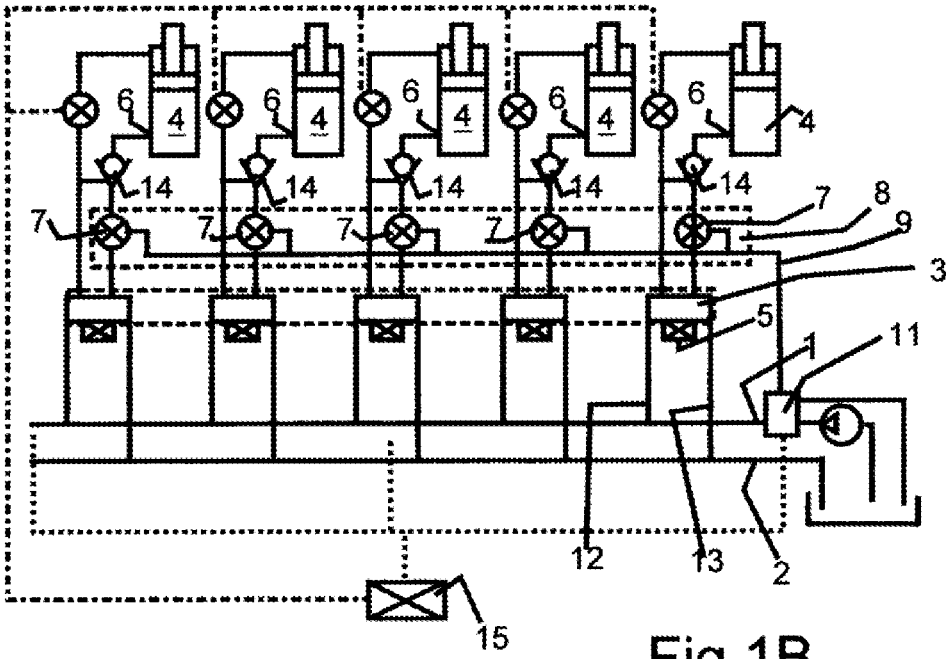
Figure 2:
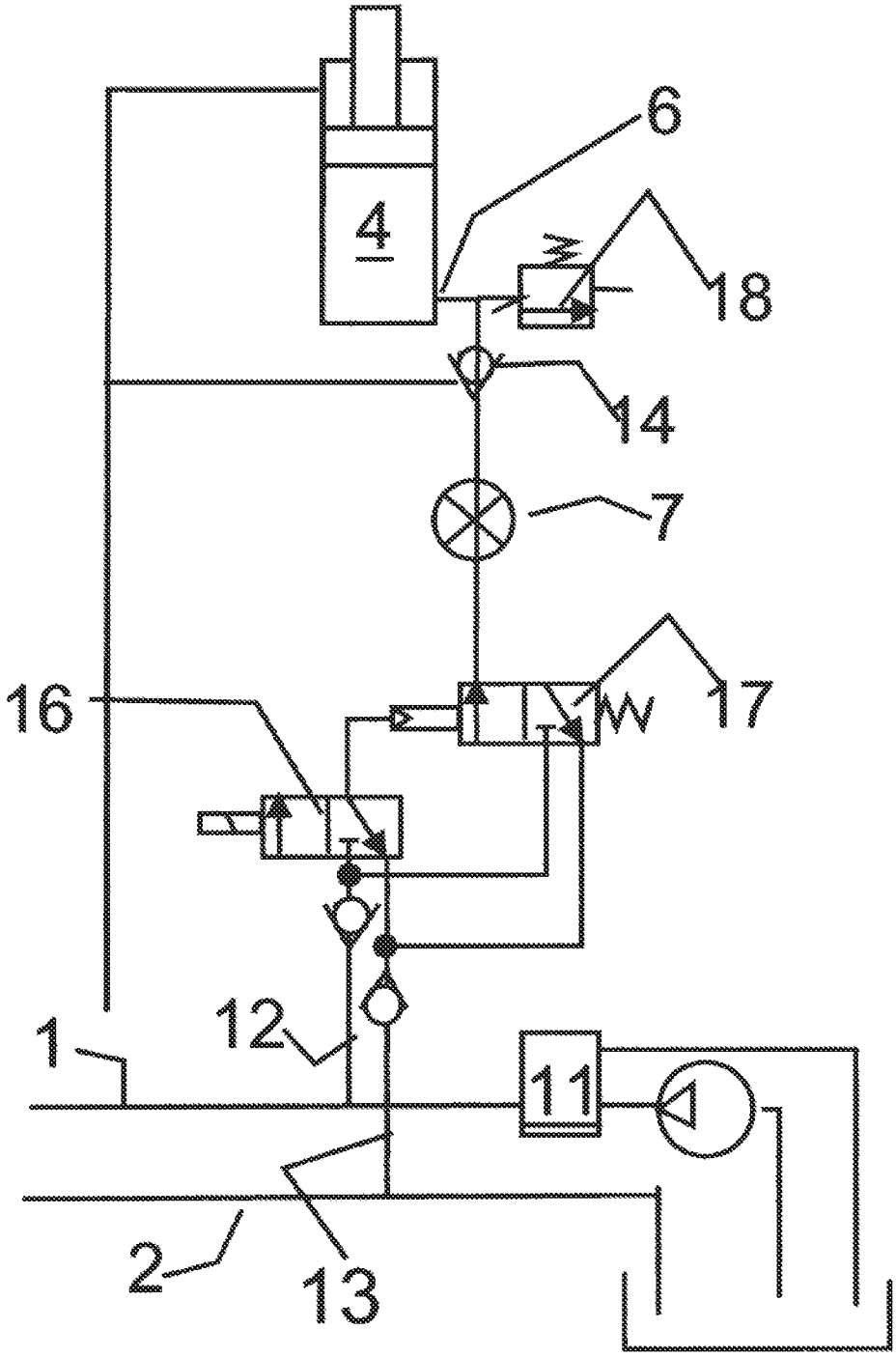
FIG. 2: The valves for a power source in a support shield The reference numbers in the illustrations include.

In the detailed diagram in FIG. 2, the individual valves of the hydraulic control unit 3 are illustrated—additionally to FIG. 1. The pilot control valve 16 is controlled by the electrical control unit of the support shield, and hydraulically switches the main valve between two positions:

Upon hydraulic activation by the pilot control valve, the main valve releases the connection between the longwall control unit (pump line, pressure line) 1 and the outlet 6 of the cylinder of the power source 4; the piston of the power source is raised.

If hydraulic activation by the pilot control valve is discontinued, the main valve releases the connection between the releasable check valve 14/load holding valve and the collective return line 2, with the result that the pressure in this line falls substantially to the pressure in the collective return line 2.

At this point, this pressure is now monitored by the pressure monitoring device 7 according to the invention. As such, the function of the main valve 17 is monitored at the same time.

In just the opposite manner, a pressure monitoring device 7 can also be provided, such pressure monitoring device being of a type that the operation piston of the main valve 17 is monitored, and a signal is produced if the operation piston does not move to the position prespecified by the position of the pilot control valve 16, or does not fully move to said position.

With respect to the previous description, the further extension of the design in FIG. 1B is only characterized in that the ring piston line 10 of each cylinder/piston unit 4 is also monitored by a pressure sensor 19. Each of these pressure sensors 19 is switched into the system via a further bus line 20 or optionally via the central longwall control unit 15 in such a manner that the longwall shutoff valve is activated if a prespecified maximum pressure is reached in the ring piston line 10, and the entire longwall system can be depressurized. Also in this way, the design ensures that no inherent system pressure is present, which could release the check valve holding the roof pressure. For this reason, the permissible maximum pressure at which all support shields of the longwall system are depressurized is set clearly at least 20% lower—for example, at 50 bar pressure—than the inherent system pressure of, for example, 80 bar, which is sufficient for releasing the check valve.

The invention claimed is:

1. A hydraulic circuit configured to cooperate with a plurality of support shields for longwall mining in underground mines, wherein each support shield comprises at least one hydraulic cylinder/piston unit for executing a mining function such as setting, stepping, and clearance, wherein the at least one hydraulic cylinder/piston unit is connected to a support shield control valve via a releasable check valve and a pressure line, wherein the at least one hydraulic cylinder/piston unit can be connected to a pump line by a first actuation of the support shield control valve, or to a return line by a second actuation of the support shield control valve and simultaneous release of the releasable check valve, and wherein the at least one hydraulic cylinder/piston unit can be blocked with respect to the pressure line by closing the releasable check valve, said hydraulic circuit further comprising a pressure monitoring device that is disposed in the pressure line between the releasable check valve and the support shield control valve.

2. The hydraulic circuit according to claim 1, wherein the pressure monitoring device is a device for monitoring a position of a piston of the support shield control valve, said device producing a deviation signal to indicate a deviation of the position of the piston of the support shield control valve from a target position prespecified by a support shield control unit.

3. The hydraulic circuit according to claim 2, wherein an acoustic or visual signal is produced if the deviation signal exceeds a prespecified threshold value.

4. The hydraulic circuit according to claim 2, wherein the at least one cylinder/piston unit is depressurized via the support shield control unit if the deviation signal exceeds a prespecified threshold value.

5. The hydraulic circuit according to claim 1, wherein the pressure monitoring device is a pressure sensor in the pressure line between the support shield control valve and the releasable check valve, said pressure monitoring device producing a deviation signal to indicate a deviation of an actual current pressure from the target pressure prespecified by a support shield control unit.

6. The hydraulic circuit according to claim 5, wherein an acoustic or visual signal is produced if the deviation signal exceeds a prespecified threshold value.

7. The hydraulic circuit according to claim 5, wherein the at least one cylinder/piston unit is depressurized via the support shield control unit if the deviation signal exceeds a prespecified threshold value.

8. The hydraulic circuit according to claim 1, wherein the pressure monitoring device is a pressure switch.

9. The hydraulic circuit according to claim 1, wherein multiple support shield control valves are collected into a single unit in one support shield, wherein the pressure lines from each of the support shield control valves to the cylinder/piston unit assigned to the same contain a pressure monitoring device which is collected into a monitoring component, wherein the monitoring component is provided with hydraulic connections configured to allow an inlet and outlet of the pressure lines from the support shield control valves to the pressure monitoring device and from the pressure monitoring device to the check valve of the associated cylinder/piston unit, wherein the monitoring component is connected to the support shield control unit via a common bus line to which all associated pressure monitoring devices are connected, and wherein each pressure monitoring device can respond to the support shield control unit by means of a codeword for acquiring the pressure signal, said codeword being unique to each pressure monitoring device.

10. The hydraulic circuit according to claim 1, wherein a ring piston line of each cylinder/piston unit is also monitored by a pressure sensor, via which the entire longwall system can be depressurized upon a prespecified maximum pressure being reached.

11. A hydraulic circuit for longwall mining in underground mines, for the purpose of supporting a longwall using multiple support shields, of which each support shield is equipped with hydraulic cylinder/piston units for executing a mining function involving setting, stepping, and clearance, wherein each cylinder/piston unit is connected to a support shield control valve via a releasable check valve (load holding valve) and a pressure line, and can be connected to a pump line or, in the event that the check valve is released, to a return line by means of the support shield control valve upon specification of the support shield control valve assigned to each support shield, or can be blocked with respect to the pressure line by means of the check valve, and wherein a ring piston line of each cylinder/piston unit is also monitored by a pressure sensor, via which an entire longwall system can be depressurized upon a prespecified maximum pressure being reached.

* * * * *